United States Patent [19]

Nagai et al.

[11] Patent Number: 4,647,271

[45] Date of Patent: Mar. 3, 1987

[54] IMPELLER OF CENTRIFUGAL BLOWER

[75] Inventors: Makoto Nagai, Yaizu; Isamu Horiuchi; Masamichi Hanada, both of Shimizu; Sigeaki Kuroda; Masakatsu Hayashi, both of Shimizu; Yasuro Ohishi, Fujieda; Yutaka Mori, Shizuoka; Eiji Maeda, Shimizu; Kimito Kasukabe, Shizuoka; Yuji Tsujita; Hironori Etou, both of Shimizu; Katsuaki Kikuchi; Masato Itagaki, both of Shimizu, all of Japan

[73] Assignee: Hitachi, Ltd., Tokyo, Japan

[21] Appl. No.: 742,596

[22] Filed: Jun. 7, 1985

[30] Foreign Application Priority Data

| | | | |
|---|---|---|---|
| Jun. 8, 1984 | [JP] | Japan | 59-116365 |
| Jun. 8, 1984 | [JP] | Japan | 59-116366 |
| Aug. 22, 1984 | [JP] | Japan | 59-173219 |
| Feb. 27, 1985 | [JP] | Japan | 60-36308 |

[51] Int. Cl.[4] ..... F04D 29/30

[52] U.S. Cl. ..... 416/186 R; 416/188

[58] Field of Search ..... 416/186 R, 188, 187, 416/181, 184, 182, 183, 185, 180, 179, 186 A, 223 B, 235, 237 R; 415/214, 213 R; 29/156.8 CF, 156.4 R; 425/DIG. 5; 264/318

[56] References Cited

U.S. PATENT DOCUMENTS

| | | | |
|---|---|---|---|
| 2,247,813 | 7/1941 | Huitson | 29/156.8 CF |
| 3,257,071 | 6/1966 | Harris | 416/187 |
| 3,515,498 | 6/1970 | Tomita | 416/186 R |
| 3,536,416 | 10/1970 | Glucksman | 416/187 |
| 4,043,385 | 8/1977 | Petrenchik | 425/DIG. 5 |
| 4,211,514 | 7/1980 | Hawes | 416/186 R |
| 4,362,468 | 12/1982 | Nishikawa et al. | 416/186 R |
| 4,549,103 | 10/1985 | Shiga | 416/237 |

FOREIGN PATENT DOCUMENTS

| | | | |
|---|---|---|---|
| 145005 | 12/1979 | Japan | 29/156.8 CF |
| 134797 | 10/1980 | Japan | 416/185 |
| 18349 | of 1911 | United Kingdom | 416/186 R |
| 548005 | 9/1942 | United Kingdom | 416/187 |

*Primary Examiner*—Everette A. Powell, Jr.

*Attorney, Agent, or Firm*—Antonelli, Terry & Wands

[57] ABSTRACT

An impeller of a centrifugal blower includes a hub, a hub plate, a plurality of blades and a shroud. The hub plate has an outer diameter which is smaller than an inner diameter of the shroud and a portion of the blades existing in the difference between the diameters is provided with a parting plane of molds, whereby the impeller can be integrally molded by the injection molding.

14 Claims, 35 Drawing Figures

IMPELLER OF CENTRIFUGAL BLOWER

BACKGROUND OF THE INVENTION

This invention relates to impellers of centrifugal blowers for use with air conditioning systems and other equipment, and, more particularly, to with an impeller of a unitary structure having blades of a configuration suitable for use with a centrifugal blower of low noise characteristic.

In, for example, U.S. Pat. No. 4,211,514, an impeller is proposed which includes a hub, a hub plate, a plurality of blades and a shroud.

Heretofore, various methods available for manufacturing the above described type of impeller have been proposed. In one method, the hub, hub plate and baldes are formed as a unitary structure, and the shroud is formed separately and joined to the unitary structure with, for example, a solvent. In another method, the shroud is mounted to a packaged unit of air conditioning system, for example, so that it will replace an impeller of the unitary structure. In still another method, the hub, hub plate and shroud are separately formed by pressing a sheet metal and joined to each other by spot welding, to assemble them together. Some disadvantages have been associated with these methods of the prior art for manufacturing impellers. The operation of assembling the parts, using a solvent or spot welding or the like, inevitably produces variations from one completed impeller to another, even if a worker strictly follows present procedures performing the manufacturing operation, rules governing the use of tools and materials, and number of inspections to be made as standards of operation. When the hub, hub plate and blades are formed as a unitary structure, and the shroud is separately formed and joined to the unitary structure, such method has a drawback which sufficient dimensional precisions of surfaces at which they are joined together cannot be obtained by shrinkage. This decreases the strength of the impeller thereby causing a reduction in reliability. To avoid this disadvantage, the impeller requires a machining operation to finish the dimensional precision thereof. The disadvantage noted hereinabove would become marked as the size of the impeller increases. When injection molding is used, it is necessary to employ a split mold for producing the blades which radially extend from the center of the impeller to its outer periphery. In molding the blades by using the split mold, it is necessary to remove the blades from the mold by starting with portions of the blades located at the outer periphery of the impeller and successively moving them vertically. This renders the construction of the mold complex, greatly increasing the cost of the mold.

An object of this invention is to provide an impeller of a centrifugal blower comprising a plurality of two-dimensional blades capable of being formed as a unitary structure by using a synthetic resin material and exhibiting a performance approximating that of three-dimensional blades.

Another object is to provide an impeller of a centrifugal blower exhibiting an improved efficiency which does not have variations in performance and strength.

One of the outstanding characteristics of the invention is the blades of two-dimensional profile of which the inner diameter on the hub plate side is smaller than on the shroud side and the radius of curvature of each blade at the blade inlet is successively reduced in going from the shroud toward the hub plate within the difference of the inner diameters.

Another outstanding characteristic is the blades of two-dimensional profile of which the outer diameter on the hub plate side is greater than on the shroud side and the curvature of each blade at the blade outlet is varied within the difference of the outer diameters so as to keep the blade outlet angle constant or nearly constant.

Still another outstanding characteristic is that the impeller can be formed integrally, so that there is no variation in performance and strength of the impeller. The hub, hub plate, blades and shroud are formed integrally, so that it is possible to eliminate the need to perform the operation of joining the parts together. This can reduce the cost. The outer diameter of the hub plate is smaller than the inner diameter of the shroud, and the parting plane of the molds is located in the blade section being within this difference of diameters. By this arrangement, the two molds used are of the most simple combination of movable and stationary molds which form a pair. This reduces the cost of mold. Another outstanding characteristic is the blade of the impeller of which thickness of the inlet side is slightly greater than that of the outlet side and the draft angles of the fluid pressure side and the back side of the blade in the same mold are different from each other and the angle provided at the inlet side of the blade is varied from that provided at the outlet side thereof, to thereby ensure that the inlet side of the fluid pressure side projects farther than the outlet side of the fluid pressure side at the main fluid flow line and that the outlet side of the backside projects farther than the inlet side of the backside with an obtuse angle. This arrangement enables a turbulence of airflow and the concentration of stresses to be avoided and makes it possible to form an impeller of a large diameter integrally.

Another outstanding characteristic is the impeller which comprises an integrally molded impeller assembly comprising a hub, a hub plate, a plurality of blades and shroud and a hub ring having an outer diameter greater than the inner diameter of the shroud and being secured to an outer periphery of the hub plate and end faces of the plurality of blades. The provision of the hub ring enables the mean outer diameter of the array of the blades to be increased to provide improvements in performance, so that the impeller provided with the hub ring can have high efficiency than the impeller having no hub ring even if the number of revolution is reduced. If the number of revolution can be reduced the impeller provided with the hub ring has increased strength because the stress is in proportion to the square of the number of revolution.

Figure 19:
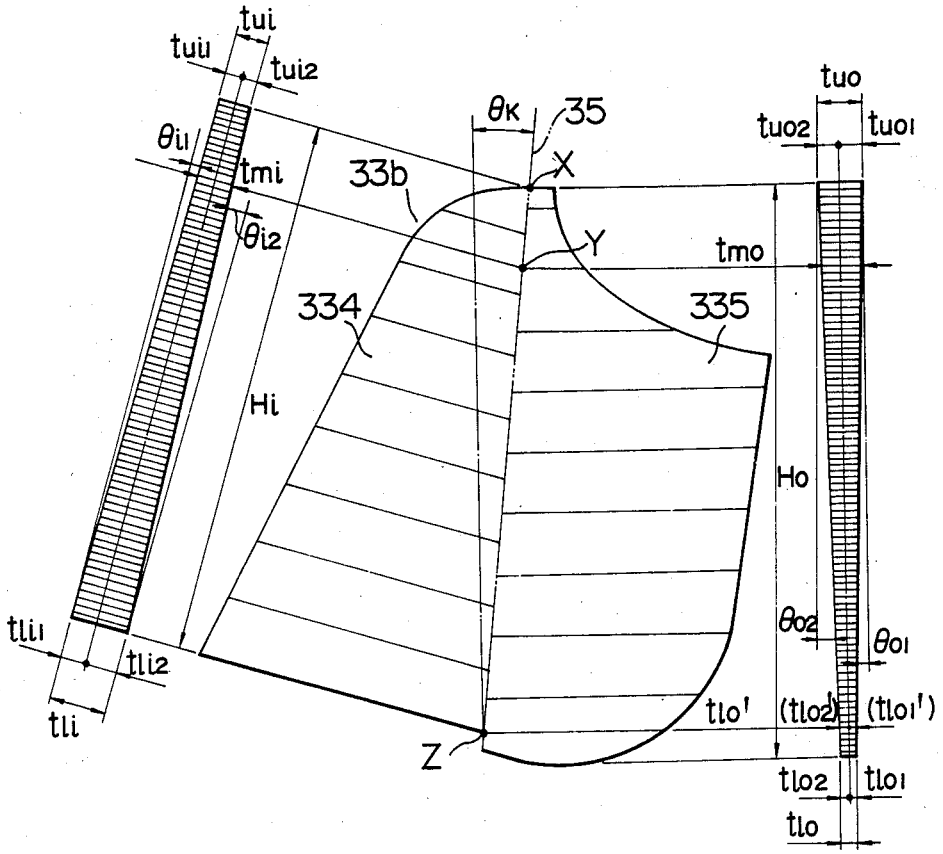
FIG. 19 is a diagram showing the profile and the thickness of the blade of another embodiment of the invention having a large diameter.
Figure 20:
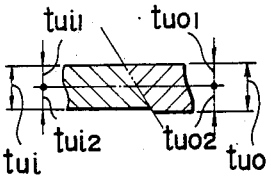
Figure 21:
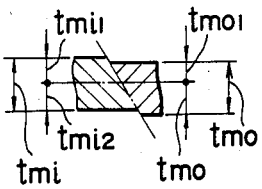
Figure 22:
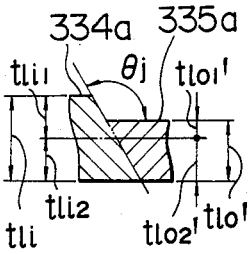
Figure 23:
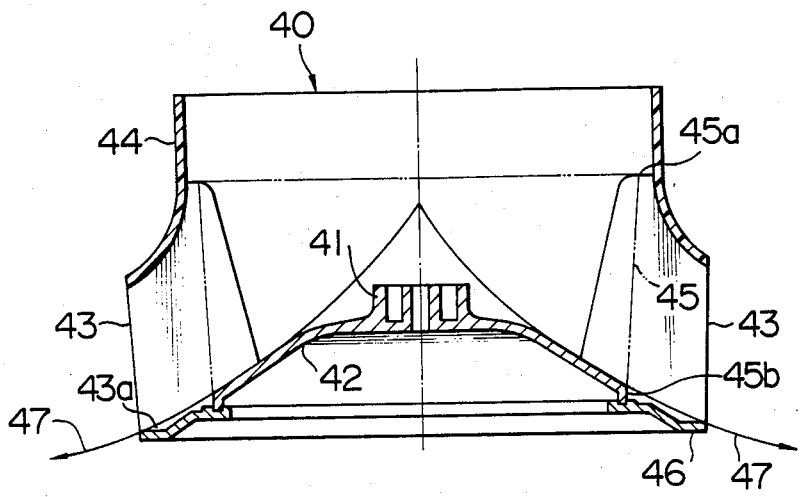
Figure 24:
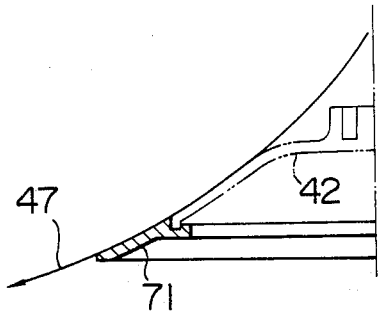
Figure 25:
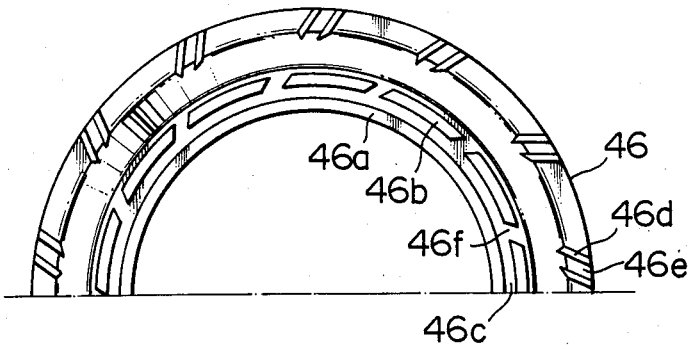
Figure 26:
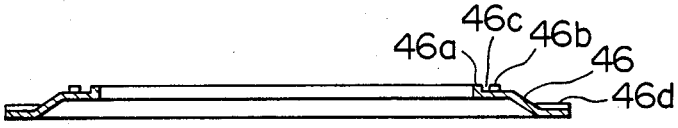
Figure 27:
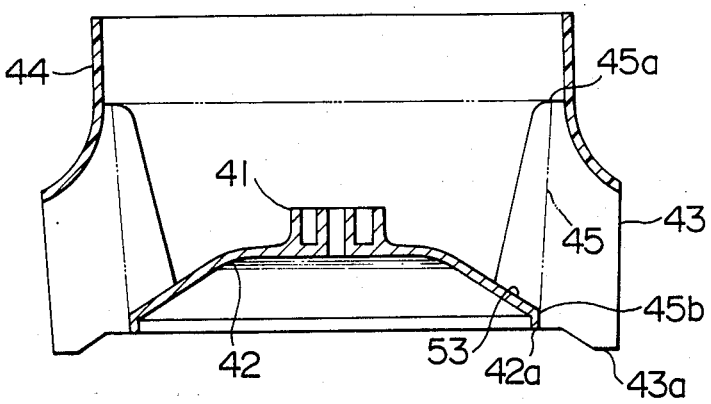
Figure 28:
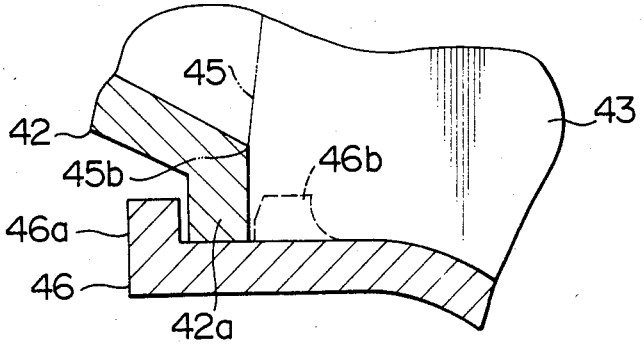
Figure 29:
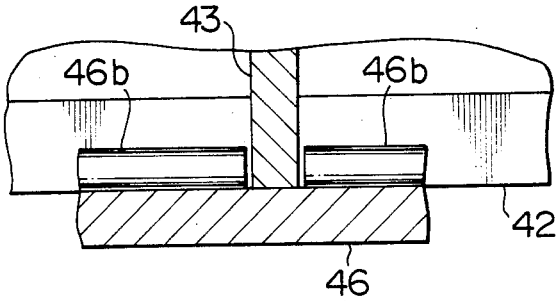
Figure 30:
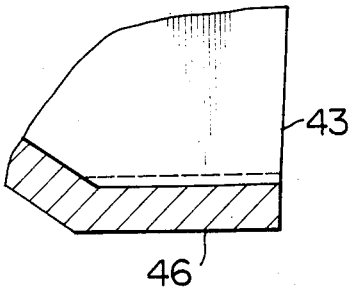
Figure 31:
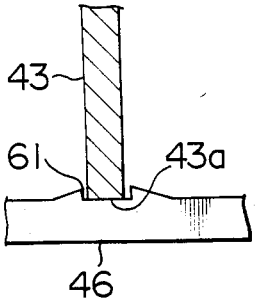
Figure 32:
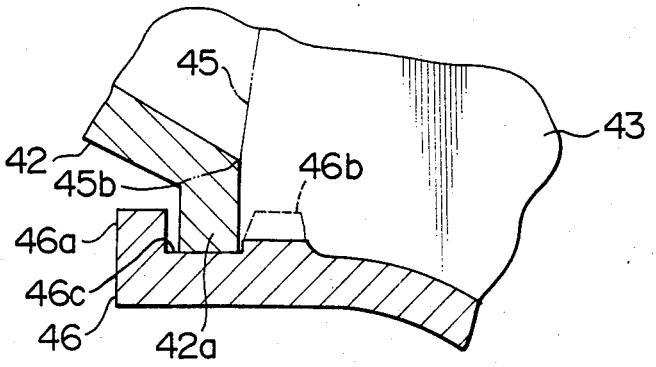
Figure 33:
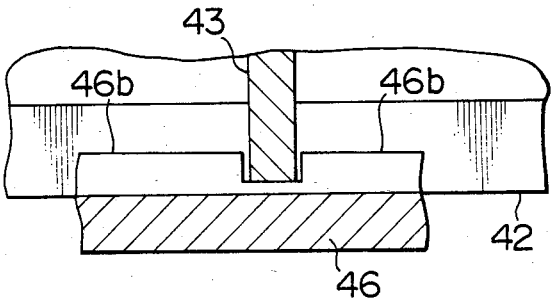
Figure 34:
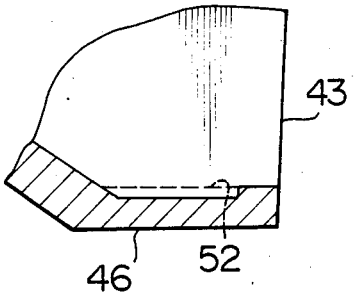
Figure 35:
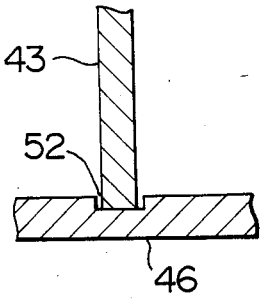

FIGS. 20, 21 and 22 re sectional views of the blade taken at the points X, Y and Z, respectively, in FIG. 19;

FIG. 23 is a sectional view of an integral molded impeller provided with one constructional form of the hub ring according to the invention;

FIG. 24 is a fragmentary view of another constructional form of the hub ring;

FIG. 25 is a plan view of the hub ring shown in FIG. 23;

FIG. 26 is a sectional view of the hub ring shown in FIG. 23;

FIG. 27 is a sectional view of the impeller assembly shown in FIG. 23;

FIG. 28 is a fragmentary sectional view of the impeller showing the weld portion of the impeller assembly and the hub ring by super-sonic welding;

FIG. 29 is a side view of FIG. 28;

FIG. 30 is a fragmentary sectional view of the impeller showing the weld portion of the blade and the hub ring by super-sonic welding;

FIG. 31 is a side view of FIG. 30;

FIG. 32 is a fragmentary sectional view of the weld portion of the impeller assembly and the hub ring by solvent welding;

FIG. 33 is a side view of FIG. 32;

FIG. 34 is a fragmentary sectional view of the impeller showing weld portion of the blade and the hub ring by solvent welding; and FIG. 35 is a side view of FIG. 34.

DETAILED DESCRIPTION

Referring now to the drawings wherein like reference numerals are used throughout the various views to designate like parts and, more particularly, to FIGS. 1–7, according to these figures, an impeller comprises a shroud 2, a plurality of blades 3, a hub plate 4 and a hub 6. An inlet nozzle 1, serving as an air guide is located at an air inlet and an electric motor 5 is provided for rotating the impeller.

Figure 1:
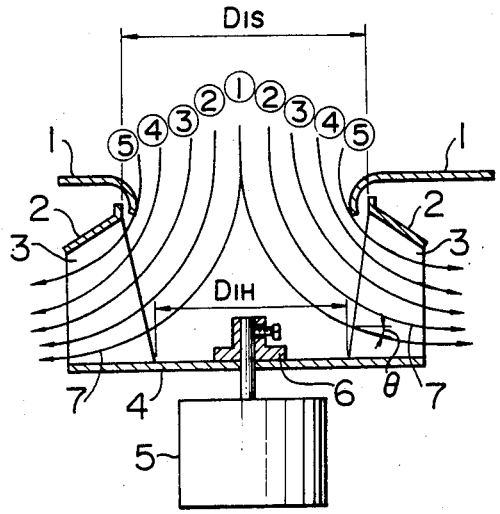
FIG. 1 is a vertical sectional view of the impeller showing fluid flow lines.
Figure 2:
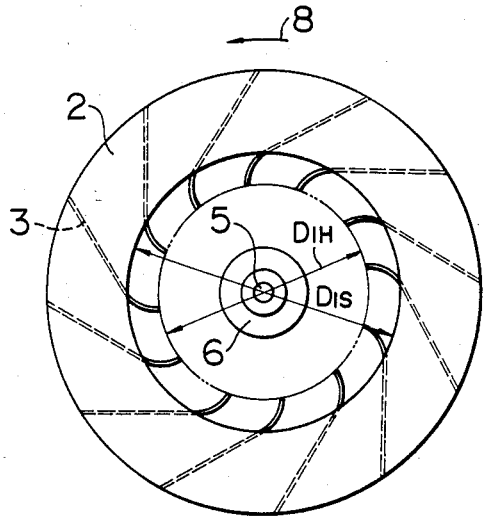
FIG. 2 is a plan view of the impeller shown in FIG. 1, with the inlet nozzle removed.

The rotation of the electric motor 5 in the direction of an arrow 8 in FIG. 2 is transmitted to the hub 6 of the impeller to cause the impeller to rotate in the same direction. Air drawn by rotation flows through the inlet nozzle 1 into the impeller as indicated by airflow lines 7 in FIG. 1.

Figure 3:
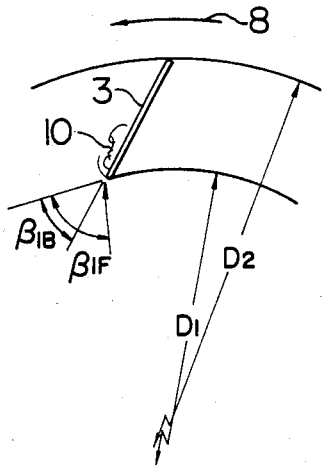
FIG. 3 is a diagram showing the relation between the inlet angle of the blade and the inlet angle of the fluid flow line.
Figure 4:
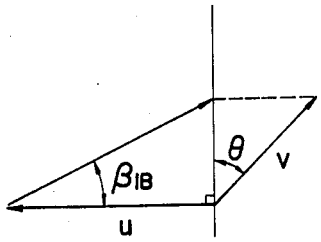
FIG. 4 is a diagram for obtaining the blade inlet angle of the blade.

In designing the blades 3, it is necessary to incline the blades 3 to match the airflow. This will be explained by referring to FIG. 3 in which the plurality of blades 3 are arranged in an array having an inner diameter $D_{1S}$ of the shroud side and an inner diameter $D_{IH}$ of the hub plate side which are equal to each other. In case that an angle $\beta_{1F}$ which air flows into is greater than the tilt angle $\beta_{1B}$ of the blades, the air flows into from the back of the blade 3 and the airflow shows a turbulence at the blade inlet as indicated at 10. As a result, the impeller exhibits a poor performance and its noise level rises. Thus, it is necessary to conform the tilt angle $\beta_{1B}$ of the blade to the angle $\beta_{1F}$ which air flows into such that the former is slightly greater than the latter. At the blade inlet, the airflow velocity of the shroud side differs from that of the hub plate side. Thus, when the inner diameter $D_{1S}$ of the array of blades 3 of the shroud side is equal to the inner diameter $D_{1H}$ of the hub plate side as shown in FIG. 3, the blades 3 become three-dimensional.

According to the invention, the inner diameter $D_{1H}$ of the array of blades 3 of hub plate side is smaller than the inner diameter $D_{1S}$ thereof of the shroud side, as shown in FIGS. 1 and 2, to conform the tilt angle $\beta_{1B}$ to the airflow. This makes it possible to produce the blades 3 in two-dimensional structure. Hereinafter a method to conform the tilt angle $\beta_{1B}$ of each blade 3 to the airflow. The tilt angle $\beta_{1B}$ of each blade 3 is determined by the peripheral velocity u of the blades 3 which may vary depending on the revolution of the impeller, the airflow velocity v and the angle $\theta$ which air flows into (see FIGS. 1 and 4). The tilt angle $\beta_{1B}$ of the blades 3 can be expressed by the equation:

$$\beta_{1B}=\tan^{-1}(v\times\cos\theta/u).$$

Figure 5:
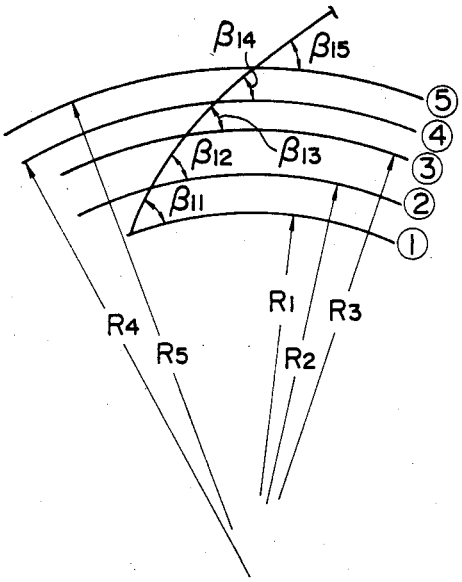
FIG. 5 is a view for explaining the design process the inlet angle of the blade.

The tilt angle $\beta_{1B}$ of each blade 3 is obtained with respect to each of airflow lines 1–5, and the tile angles $\beta_{1B}$ on the airflow lines 1–5 are connected together, as shown in FIG. 5, to thereby enable the blade tilt angle $\beta_{1B}$ to conform the airflow 7. It will be seen that the blade tilt angle $\beta_{1B}$ determined in this way becomes larger in going toward the hub plate 4.

Figure 6:
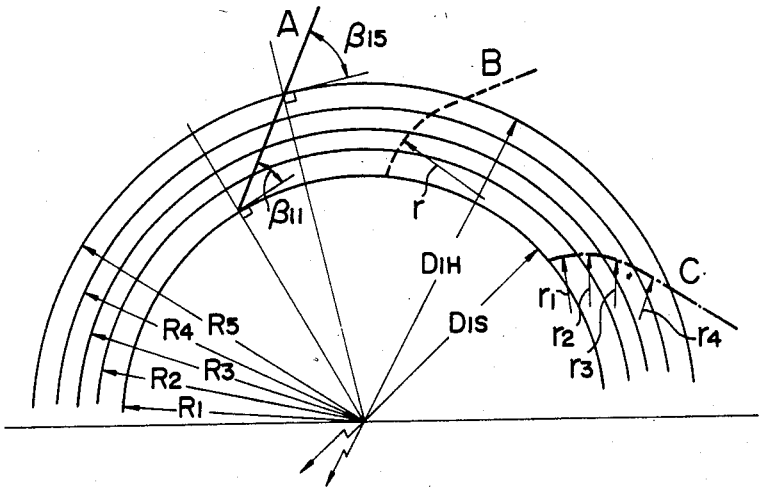
FIG. 6 is a view showing the relation between the inlet diameter and the inlet angle of the blade.

FIG. 6 shows blade profiles extending between the inner diameter $D_{1S}$ of the shroud side and the inner diameter $D_{1H}$ of the hub plate side.

FIG. 6 shows the blade profiles between $D_{1S}$ and $D_{1H}$ and the reference characters A, B and C are in the form of a straight line, an arcuate line and a combination of a plurality of arcuate lines, respectively. Here, the tilt angle $\beta_{1B}$ of the blades 3 where the radius is $R_1$ is angle formed by a tangent to a circle of the radius $R_1$ and the blade 3 as indicated by A, and is varied as shown in FIG. 7 as the radius is varied.

Figure 7:
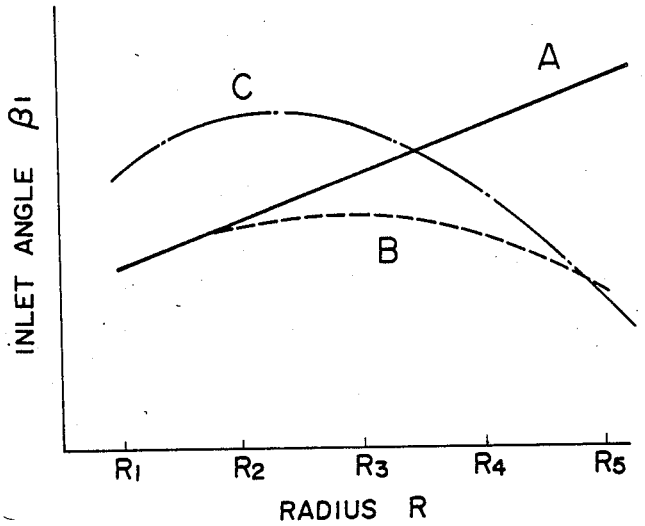
FIG. 7 is a graph showing the relation between the radius and the inlet angle of the blade.

The tilt angle $\beta_{1B}$ of the blades 3 is a value which is determined by the velocity and direction of the airflow and is generally represented by a curve C in FIG. 7.

Then, the difference in radius between $D_{1S}$ and $D_{1H}$ is divided equally by n (in FIG. 6, the difference between $R_1$ and $R_5$ is equally divided by 4), and curvatures $\gamma_1$ to $\gamma_4$ are obtained which make the tilt angle $\beta_{1B}$ at each radius to the value $\beta_{11}$ to $\beta_{15}$. By connecting from $D_{1S}$ to $D_{1H}$ by radius $\gamma$, it is possible to obtain a blade profile which conforms with the airflow 7. The invention essentially resides in two-dimension blade of which the tilt angle utilizing the difference in between $\beta_{1B}$ is conformed to the angle $\beta_{1F}$ which air flows into by utilizing the difference in diameter $D_{1H}$ and $D_{1S}$.

In the embodiment described hereinabove, each of the blades 3 have their inlet portion conformed to the angle which air flows into. Another embodiment of the invention in which the blades 3 each have their outlet portion conformed to the angle which air flows out will be described by referring to FIGS. 8–12.

As shown in FIGS. 8–12, the impeller comprises a shroud 12, a plurality of blades 13, a hub plate 14 and a hub 16. An electric motor 15 for driving the impeller for rotation is provided. An inlet nozzle 11 serving as an air guide is located at an air inlet.

Figure 9:
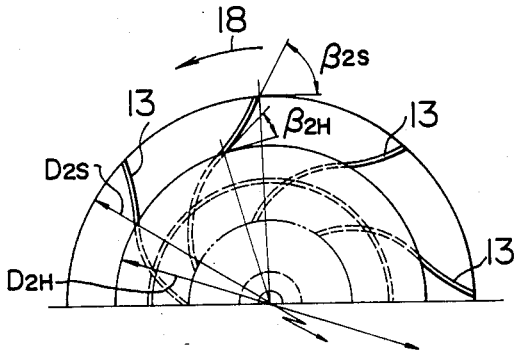
FIG. 9 is a bottom plan view of the impeller shown in FIG. 8, with the motor removed.
Figure 10:
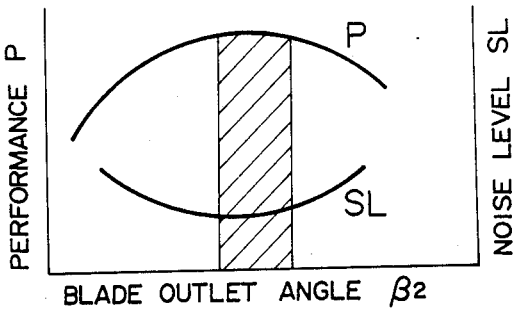
FIG. 10 is a graph showing the outlet angle of the blade in relation to the performance and noise level.

The rotation of the electric motor 15 in the direction of an arrow 18 in FIG. 9 is transmitted to the hub 16 to rotate the impeller in the same direction, with the air flow being indicated by arrows 17.

To maximize the efficiency, it is necessary that the outlet angle of the blade have a value which is in a certain range of values. To this end, it is necessary for the blades 13 to be a three-dimension profile. When the blades have a three-dimension profile, molds for forming the impeller would become complex in construction and high in cost. Therefore, in the invention, the blade is made to a two-dimension profile and the outlet angle of the blade is made to have a suitable value.

Figure 8:
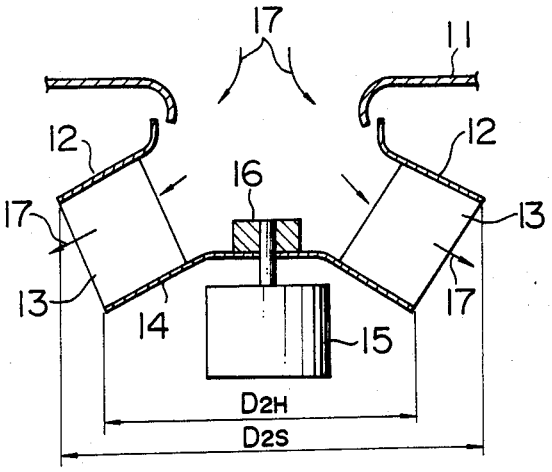
FIG. 8 is a vertical sectional view of an impeller constructed in accordance with another embodiment of the present invention.

As shown in FIG. 8, the array of blades 13 has an outer diameter $D_{2H}$ of the hub plate side which is smaller than its outer diameter $D_{2S}$ of the shroud side. The outlet angles $\beta_2$ of the blade at each diameters $D_{2H}$, $D_{2S}$ are conformed to the values which optimise the performance of the impeller. Then, the outlet angles of the blade at each diameters $D_{2H}$, $D_{2S}$ are connected, so that the blade profile between the diameters $D_{2H}$, $D_{2S}$ is determined.

The blade profile between the outer diameters $D_{2H}$ and $D_{2S}$ is a concaved surface having the center of its curvature existing outwardly of the blades 13 as viewed from the bottom side of the impeller.

Figure 11:
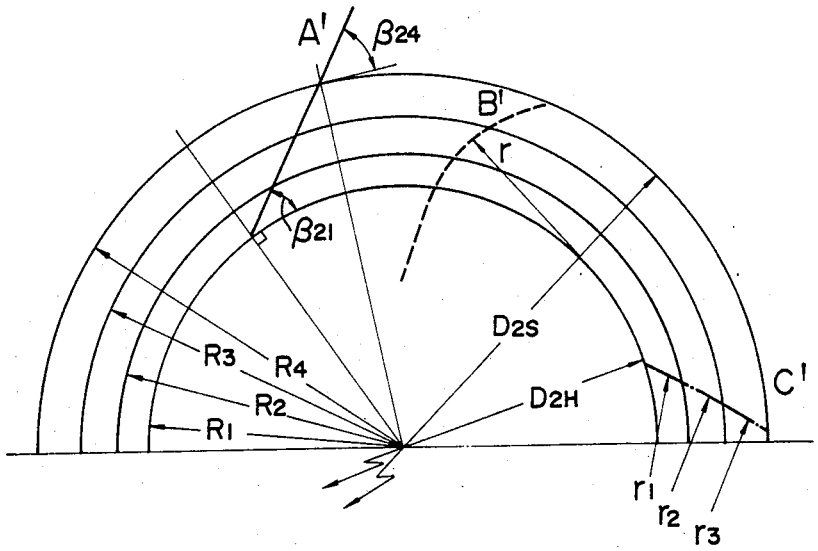
FIG. 11 is a view showing the relation between the outlet diameter and the outlet angle of the blade.

FIG. 11 shows blade profiles between the outer diameters $D_{2H}$ and $D_{2S}$ wherein the values of the outer diameters are different.

A blade profile in the form of a straight line, a blade profile in the form of an arcuate line and a blade profile in the form of a combination of a plurality of arcuate lines are indicated by reference characters A', B' and C', respectively. Each of outlet angles $\beta_2$ is an angle formed by the blade 13 and a tangent line of each of circles of the radii at the cross point of the blade and each of circles. The value of the outlet angle $\beta_2$ of the blade which optimizes the efficiency of the impeller is determined by experiment.

Figure 12:
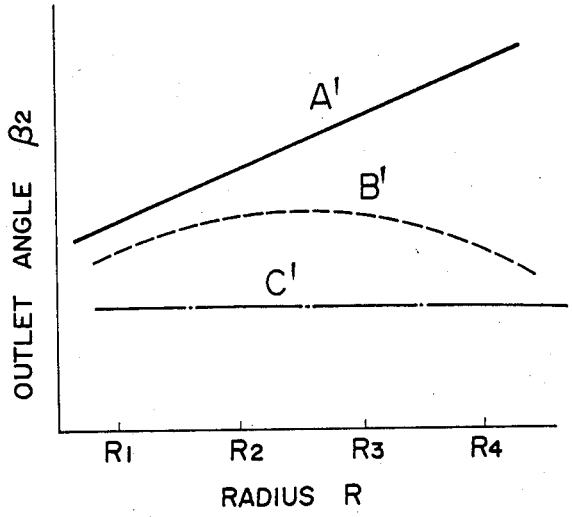
FIG. 12 is a graph showing the relation between the radius and the outlet angle of the blade.

As shown in FIG. 12, where the blade 13 is in the form of a straight line A', the outlet angle $\beta_2$ of the blade increases in value as the radius R increases, and where the blade 13 is in the form of an arcuate line B', the outlet angle $\beta_2$ of the blade shows a curve as the radius R increases. To optimize the value of the outlet angle $\beta_2$ of the blade, the difference between the outer diameters $D_{2S}$ and $D_{2H}$ is divided equally by the numeral n, and a curvature $\gamma$ which optimizes the efficiency of the angle $\beta_2$ for each value of the radius R is obtained. By connecting the portions of the outer diameters $D_{2H}$ and $D_{2S}$ together by the curvature $\gamma$, it is possible to obtain an optimum value of the outlet angle $\beta_2$ of the blade as represented by a line C' in FIG. 12.

In the embodiments described hereinabove, it is possible to provide a two-dimension blade with the inlet angle or the outlet angle of the blade which maximizes the efficiency of the impeller, thereby improving the performance of the impeller and lowering its noise level. Having an array of two-dimension blades, the impeller according to the above-described embodiments is low in cost because it can be formed of a synthetic resin material as a unitary structure.

Another embodiment of the invention shown in FIGS. 13 and 14 which is an impeller of straight blades that can be formed integrally by means of a pair of molds of simple construction, will now be explained.

Figure 13:
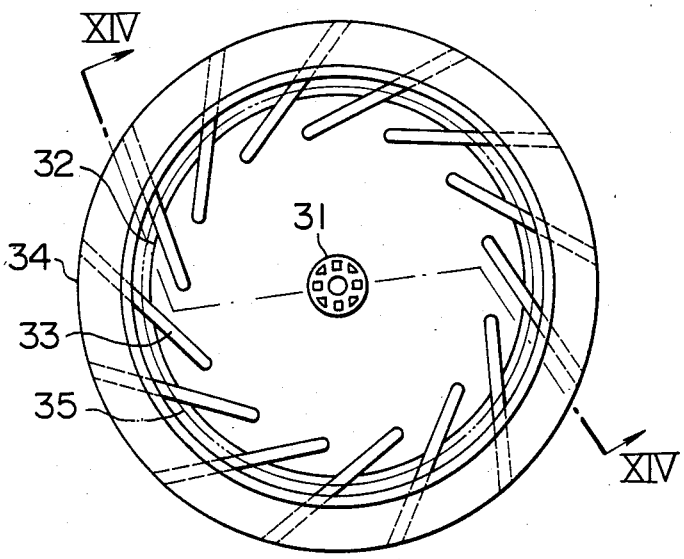
FIG. 13 is a plan view of the impeller formed integrally according to the invention, showing the basic profile.
Figure 14:
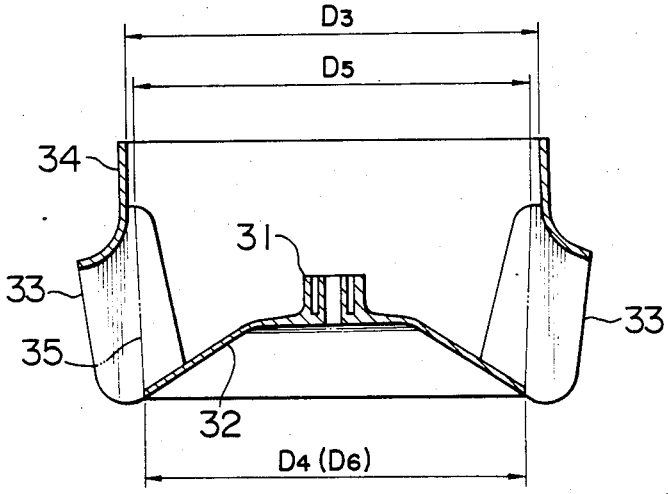
FIG. 14 is a sectional view of the impeller taken along the line XIV–XIV in FIG. 13.

Referring to FIGS. 13 and 14, the impeller comprises a hub 31 located in a central portion of the impeller for transmitting a motive force from a motor, a hub plate 31 which has a convexed surface to the side of the hub 31 to prevent deformation due to centrifugal forces, a shroud 34 and a plurality of blades 33. The hub plate 32 has an outer diameter $D_4$ which is smaller than an inner diameter $D_3$ of the shroud 34. The shroud 34 defines a maximum outer diameter of the impeller.

The plurality of blades 33 form an array having a line 35 indicating a parting plane of the molds having a minimum diameter $D_6$ and a maximum diameter $D_5$. These diameters are related to the outer diameter $D_4$ of the hub plate 32 and the inner diameter $D_3$ of the shroud 34 as follows:

$$D_3 \geqq D_5 \geqq D_6 \geqq D_4$$

An embodiment including above-mentioned equal mark or marks is carried into practice where the blades 33 have a small height and where the impeller can be readily removed from the molds after being molded and where there is no risk that the molds might be worn or damaged. The possibility to use the equal mark or marks is judged from each material.

Where the impeller has a great outer diameter, the following relation holds between the minimum and maximum diameters $D_6$ and $D_5$ of the parting plane of the molds, the outer diameter $D_4$ of the hub plate 32 and the inner diameter $D_3$ of the shroud 34:

$$D_3 \geqq D_5 > D_6 \geqq D_4$$

And the parting plane of the molds is in the form of a triangular cone. In FIG. 13, the configuration of each part is determined such that a movable mold can be used for the shroud side and a stationary mold can be used for the hub plate side. However, this is not restrictive and the configuration of each part may be determined such that the stationary mold can be used for the shroud side and the movable mold can be used for the hub plate side. In this case, the aforesaid relationship also holds.

The embodiment shown in FIGS. 13 and 14 enables the hub, hub plate, blades and shroud to be produced as a unit by means of a pair of molds of simple construction. This can prevent the variations in performance and strength due to the variation of the operations. The embodiment also makes it possible to reduce cost because of the elimination of the assembling operations.

Next, an embodiment concerning the thickness of the blades in relation to the strength of the blades and the performance of the impeller will be discussed.

Figure 15:
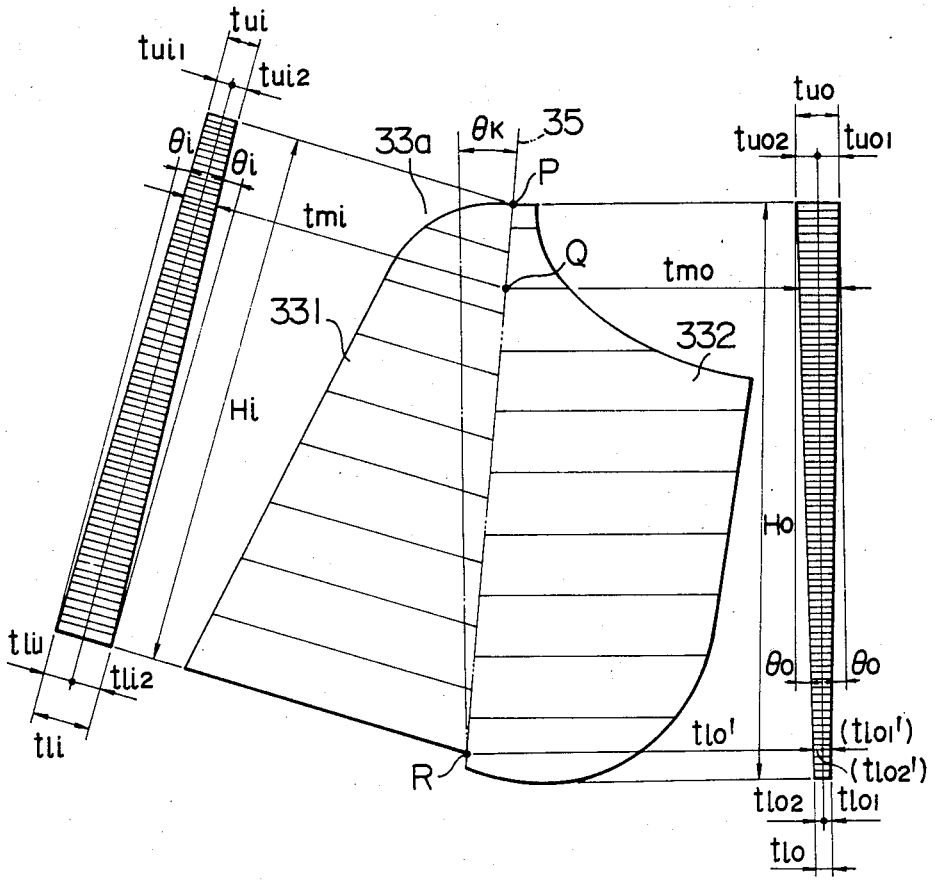
FIG. 15 is a diagram showing the profile and thickness of the blade cut out from FIG. 14.
Figure 16:
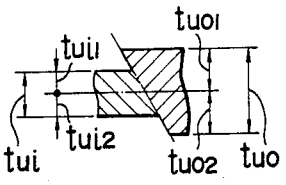
FIG. 16 is a sectional view of the blade taken at the point P in FIG. 15.
Figure 17:
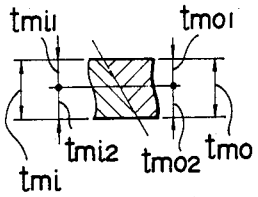
FIG. 17 is a sectional view of the blade taken at the point Q in FIG. 15.
Figure 18:
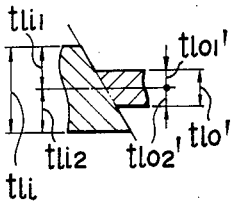
FIG. 18 is a sectional view of the blade taken at the point R in FIG. 15.

FIG. 15 shows the profile and thickness of a blade 33*a* of an impeller produced as a unitary structure by molding. In FIG. 15, a portion of the blade 33*a* of the fluid inlet side is designated by 331, a portion of the blade 33*a* of the fluid outlet side is designated by 332 and the tilt angle of a parting line 35 of the molds is designated by $\theta_K$. Usually, the draft angle in the same mold needs 20′ at minimum although depending on the side of the product and the type of a material used for molding. Because of this, the blade called uniform thickness has a difference in level between the blade portion produced by the stationary mold and the blade portion produced by the movable mold as shown in FIGS. 15 to 18. FIGS. 16, 17 and 18 show cross-sectional shapes of the blade at points P, Q and R in FIG. 15, respectively. In FIGS. 16–18, the subscripts l and u designate the hub plate side and the shroud side, respectively. The subscripts i and o respectively designate the fluid inlet side and the fluid outlet side of the molds divided by the line 35 representing the parting plane of the molds. The subscripts 1 and 2 designate the surface to which fluid pressure is applied and the back of the surface to which fluid pressure is applied, respectively.

In FIG. 13, the following relation holds with regard to the thickness of the blades:

| | |
|---|---|
| Fluid Inlet Side | $t_{ui} = t_{ui1} + t_{ui2}$ |
| | $t_{mi} = t_{mi1} + t_{mi2}$ |
| | $t_{li} = t_{li1} + t_{li2}$ |
| Fluid Outlet side | $t_{uo} = t_{uo1} + t_{uo2}$ |
| | $t_{mo} = t_{mo1} + t_{mo2}$ |
| | $t_{lo} = t_{lo1} + t_{lo2}$ |

where t is the thickness of the blade. If the draft angle and the height of the blade are respectively denoted by $\theta$ and H, the following relation can be held.

$$t_{li}=t_{ui}+2\times H_i\times\tan(\theta_i)>t_{ui}$$

$$t_{lo}=t_{uo}-2\times H_o\times\tan(\theta_o)<t_{uo}$$

Where the impeller is formed of a synthetic resin material, the rate of the material in the cost is relatively high, making it preferable to minimize the thickness of the blade. To this end, the blade is designed to have the same thickness on the inlet and outlet sides. It is well known in the art that this produces a difference in thickness between the fluid inlet side and fluid outlet side of the blade at the parting plane, and that when a projection exists on the surface of the blade to which fluid pressure is applied, it interferes with the flow of fluid and causes a turbulent flow. Meanwhile, to produce a fluid flow, the blades make an acute angle with the radial lines extending outwardly from the center of rotation of the impeller at the parting plane of the molds. Thus, the rotation of the impeller tends to cause stress to be concentrated in a concavity formed on the back of the surface to which fluid pressure is applied, thereby rupturing the blades. This makes it necessary to increase the thickness of the blades and to provide the blades with a curvature to avoid the concentration of stress. As a result, the material cost increases. Impellers that can tolerate a small thickness blades are generally less than 100 mm in outer diameter.

A still another embodiment in which the invention is applied to an impeller of a larger size having an outer diameter of more than 100 mm will now be described.

FIG. 19 shows the profile and thickness of a blade 33*b* of an impeller to which the invention is applied. In the FIG. 19, the reference numerals 334 and 335 designate a portion of the blade 33*b* located on the fluid inlet side and a portion thereof located on the fluid outlet side, respectively.

The blade 33*b* shown in FIG. 19 is designed as follows. The portion 334 of the blade 33*b* located on the fluid inlet side has a draft angle $\theta_{i1}$ at the surface to which fluid pressure is applied, which is smaller than a draft angle $\theta_{i2}$ at the back of the surface to which fluid pressure is applied, and the portion 335 of the blade 33*b* located on the fluid outlet side has a draft angle $\theta_{o1}$ at the surface to which fluid pressure is applied, which is smaller than a draft angle $\theta_{o2}$ at the back of the surface to which fluid pressure is applied. As shown in FIG. 20, the portion 334 of the blade 33*b* located on the fluid inlet side has at the point X, at the upper end of the blade 33*b*, a thickness $t_{ui}$ which is smaller than a thickness $t_{uo}$ of the portion 335 of the blade 33*b* located on the fluid outlet side and a fluid pressure side thickness $t_{ui1}$ of the fluid inlet side is equal to a fluid pressure side thickness $t_{uo1}$ of the fluid outlet side. As shown in FIG. 21, the portion 334 of the blade 33*b* located on the fluid inlet side has at the point Y, at the end of a main current of fluid flow, a fluid pressure side thickness $t_{mi1}$ which is greater than a fluid pressure side thickness $t_{mo1}$ of the portion 335 of the blade 33*b* on the fluid outlet side. As shown in FIG. 22, the portion 334 of the blade 33*b* located on the fluid inlet side has at the point Z, at the lower end of the blade 33*b*, a fluid pressure side thickness $t_{li1}$, which is greater than a fluid pressure side thickness $t_{lo1}'$ of the portion 335 of the blade 33*b* and a thickness $t_{li2}$ at the back of the surface to which fluid pressure is applied, which is equal to a thickness $t_{lo2}'$ of the portion 335 of the blade 335. The thickness of the blade 33*b* in the intermediate portion thereof varies from one section to another as divided by the parting plane passing through the points X, Y and Z. The thickness of the blade portion 334 is uniform along the plane parallel to the hub plate and the thickness of the blade portion 335 is uniform along the plane perpendicular to the axis of rotation of the impeller. In the impeller produced, the point X located at the upper end of the blade 33*b* may be made to coincide with the point Y.

The dimensions of the blade 33*b* described hereinabove are summarily indicated by using the symbols as follows:

At the upper end of the blade, $$t_{ui}\leqq t_{uo}$$

$$t_{ui1}\leqq t_{uo1}$$

$$t_{ui2}\leqq t_{uio2}$$

At the lower end of the blade, $$t_{li}>t_{lo}'$$

$$t_{li1}>t_{lo1}'$$

$$t_{li2}\leqq t_{lo2}'$$

In the embodiment described hereinabove in connection with FIG. 19, a fluid outlet side surface portion 335*a* of the blade surface to which fluid pressure is applied can be disposed at a lower level than a fluid inlet side surface portion 334*a* of the blade surface to which fluid pressure is applied in the range of main currents of the fluid flow at the parting plane of the stationary and movable molds, and an angle $\gamma_J$ formed by the fluid outlet side surface portion 335*a* and a parting plane can be an obtuse angle, as shown in FIG. 22. Also, to avoid the concentration of stress, a curvature may be locally provided to the blade in the range of dimensional differences including the difference in blade thickness between the upper and lower ends of the parting plane of the molds and the difference in blade thickness caused by the critical draft angle.

The invention enables the concentration of stress in the portion of the blade corresponding to the parting plane of the molds to be avoided and makes it possible to prevent the occurence of a turbulent flow which interferes with the main currents of fluid flow without increasing the thickness of the blade or by slightly increasing the blade thickness. Thus, the integrally molded impeller of a large diameter which is low in cost and high in performance can be provided.

As shown in FIGS. 23–35, an impeller 40 of a centrifugal blower comprises a hub 41, a hub plate 42, a plurality of blades 43 and a shroud 44 formed integrally by injection molding. The numeral 45 designates a parting plane of the upper and lower molds. A hub ring 46 is formed at its inner side with an annular projection 46*a* and a plurality of discontinuous projections 46*b* arranged annularly, and an annular groove 46*c* suitable for receiving an end portion 42*a* of the hub plate 42 is defined by the annular projection 46*a* and the discontinuous projections 46*b*. A plurality of projections 46*d* are formed at an outer periphery of the hub ring 46 and define a plurality of grooves 46*e* each for receiving an end portion 43*a* of one of the blades 43. The grooves 46*e* are oriented in the same direction as grooves 46*f* each defined by the two discontinuous projections 46*b*, so that the end portion 43*a* of each blade 43 is fitted to and secured in the grooves 46*e* and 46*f*. The hub plate 42 has an outer diameter which is smaller than an inner diameter of the shroud 44. The parting plane 45 of the upper and lower molds extends from an outer periphery 45*b* of the end portion 42*a* of the hub plate 42 to end 45*a* of the blades 43. The parting plane 45 of the upper and lower molds is made to have a large draft angle which the molds can be readily parted from each other. By integrally molding the hub 41, hub plate 42, blades 43 and shroud 44 by injection molding, assembling operation of the parts to provide an impeller can be discussed. Because the process for balancing the impeller during rotation can be simplified and variations in quality of impeller can be avoided, it is possible to improve the performance and to increase the reliability in operation. The draft angle of the parting plane of the movable and stationary molds is preferable as great as possible to enable the molds to be readily mounted to a molding machine and to extend the service life of the molds when the impeller is manufactured on a mass production basis. However, if the draft angle of the parting plane is made great, an end point 45*b*, namely, the diameter of the hub plate 42 must be made smaller since an end portion 45*a* of the blade 43 cannot be made greater than the inner diameter of the shroud 44. A reduction in the outer diameter of the hub plate 42 reduces the width of a portion 53 of the hub plate 42 at which the hub plate 42 and the blades 43 are joined thereby resulting the concentration of stress to this portion. Generally, in a centrifugal blower, the greater the outer diameter of the impeller becomes the higher the performance of the blower becomes and the greater the volume of the fluid is delivered by the blower. However, if the outer diameter of the impeller becomes excessively great, stress is concentrated on the roots of the blades 43 and the hub plate 42, so that the blades 43 are ruptured. When the outer diameter of the hub plate 42 is too small, a turbulent fluid flow occurring at an outer periphery of the hub plate 42 increases in magnitude, causing a reduction in efficiency and an increase in specific noise. In view of the foregoing, the hub ring 46 according to the invention is constructed to extend from the end portion 42*a* of the hub plate 42 along a fluid flow 47. As shown in FIG. 24, the hub ring may be formed in a manner to perfectly conform to the fluid flow 47 as indicated at 71. This construction further increases the smoothness of the fluid flow 47. The hub ring 46 is assembled by the ultrasonic welding or solvent welding after the end portion 42*a* of the hub plate 42 is fitted into the groove 46*c* and the end portions 43*a* of the plurality of blades 43 are fitted into the grooves 46*e* and 46*f*. As the end portions 43*a* of the blades 43 tend to be deformed by centrifugal forces, in the invention, the impeller is designed such that its performance can be stabilized by minimizing the deformation suffered by the blades to allow the blades to keep their basic profile. In order to ensure that the impeller has necessary strength, the impeller is designed such that suitable thicknesses can be selected for the hub plate 42, blades 43, hub ring 46 and shroud 44. As shown in FIGS. 28 and 29, bottom surfaces of the blades 43 and a bottom surface of the end portion 42*a* of the hub plate 42 are the same level, to avoid the concentration of stress by centrifugal forces. The annular projection 46*a* performs the function of precisely positioning the parts when they are assembled. A portion between the end portions 43*a* of the blades 43 and the end portion 42*a* of the hub plate 42 is designed to prevent the concentration of stress, and serves concurrently to maintain a clearance between the hub plate 42 and hub ring 46 which is necessary for joining the parts together by using ultrasonic welding. When the impeller is formed integrally of a synthetic resin material by injection molding, shrinkage inevitably occurs due to variations in the shape and thickness of the parts. When ultrasonic welding is employed in joining the parts together, a height of the projection for the ultrasonic welding is generally required to be about 3 mm. Such projection preferably has a triangular or trapezoidal configuration in cross section. Preferably, shrinkage is limited to about one-half of the projection 46*a* in size. In the invention, the hub plate 42 is made to extend downwardly at its outer edge, so that shrinkage will occur in a direction opposite to the blades 43, that is to say, leftwardly and rightwardly in FIG. 23. This allows the parts to be satisfactorily joined together by using ultrasonic waves by avoiding the occurrence of a shrinkage in a vertical direction.

FIGS. 30 and 31 show the end portion 43*a* of the blade 43 and the hub ring 46 after ultrasonic welding. The groove 46*e* has a width 61 which is slightly wider than the thickness of the end portion 43*a* of the blade 43 and functions the positioning of the blade 43 upon the ultrasonic welding and prevents the displacement of the blade 43 due to the rotation. The small clearance left in every part for effecting ultrasonic welding is filled with a melt of a material of the projection used for carrying out ultrasonic welding.

FIGS. 32–35 show the hub plate 42, blade 43 and hub ring 46 after joined together by using a solvent. In this embodiment, the groove 46*c* has a bottom deeper than the groove 46*f* formed by the projection 46*b* and defines a pool for solvent. The blades are formed with escapes for the projections 46*b*. The depth of this escape is about 1 mm and the corners thereof are rounded to avoid the concentration of stress. The pool for solvent prevents an outflow of the solvent before it solidifies.

FIGS. 34 and 35 show the blade 43 having its end cut off and the hub ring 46 formed with grooves 52. According to the embodiment, it is possible to effect centering both from inside and from outside. Positioning of all the parts can be effected merely by fitting the blades in the grooves 46*f* and 46*e* formed on the hub ring 46. This facilitates the operation of joining the parts together, making it possible to avoid variations in performance and strength. The provision of the hub ring enables the outer diameter of the hub plate 42 to be reduced. This makes it possible to increase the draft angle of the molds and extend the service life of the molds. Also, the outer diameter of the impeller can be increased, thereby enabling the number of revolution of the impeller to be reduced under the condition of the same quantity of fluid. This is conducive to a reduced noise level.

What is claimed is:

1. An impeller of a centrifugal blower, comprising:

a shroud;

a hub plate having an outer diameter smaller than an inner diameter of said shroud;

a hub located in a central portion of said hub plate, said hub being formed with an opening for receiving a rotary shaft and securely supporting the same;

a plurality of blades disposed between the hub plate and the shroud, connected thereto, and arranged in a circular array with the same intervals, said blades each being tilted to the radius line with a predetermined angle; and wherein said plurality of blades are integrally molded with said hub plate and said shroud by injection molding, a parting plane of said injection molding is provided at a region defined between the outer diameter of said hub plate and the inner diameter of said shroud, each of said blades comprises a fluid inlet side portion and a fluid outlet side portion, said two portions border at said parting plane of said injection molding, one of said two portions is formed by an upper mold while the other portion is formed by a lower mold, and said two portions have opposite draft angles.

2. An impeller as claimed in claim 1, wherein said plurality of blades are of a straight profile.

3. An impeller as claimed in claim 1, wherein each of said blades has a surface to which fluid pressure is applied and a back surface of said fluid-pressure applied surface, a said fluid-pressure applied surface including a difference in level of which fluid outlet side level is lower than fluid inlet side level at the parting plane of the molds, said levels being interconnected by a connecting surface portion forming an obtuse angle with the surface of the lower level, and said back surface being the same level at the parting plane of the molds.

4. An impeller as claimed in claim 1, further comprising a hub ring welded to an outer periphery of said hub plate and end faces of said plurality of blades, said hub ring having an outer diameter greater than the inner diameter of said shroud.

5. An impeller as claimed in claim 4, wherein the outer diameter of said hub ring is substantially equal to an outer diameter of the array of blades.

6. An impeller as claimed in claim 4, wherein a surface of said hub ring welded to the end faces of said plurality of blades conforms with a fluid flow line flowing along which a plane of said hub plate.

7. An impeller as claimed in claim 4, wherein said hub ring includes grooves for receiving the outer periphery of said hub plate and the end faces of said plurality of blades.

8. An impeller as claimed in claim 7, wherein said grooves for receiving the blades are discontinuous.

9. An impeller as claimed in claim 1, wherein said array of the plurality of blades has a shroud side inner diameter greater than a hub plate side inner diameter and each of said plurality of blades is of a two dimension profile.

10. An impeller according to claim 9, wherein between said hub plate side inner diameter of the blades and said shroud side inner diameter of the blades, when viewed in a direction of a rotational axis of the impeller, each of said blades has a radius of curvature successively reduced in going from the shroud side toward the hub plate side.

11. An impeller as claimed in claim 9, wherein, between said hub plate side inner diameter of the blades and said shroud side inner diameter of the blades when viewed in the direction of the rotational axis of the impeller, each of the blades comprises one arc approximating a fluid flow line.

12. An impeller as claimed in claim 1, wherein said array of the blades has a shroud side outer diameter greater than a hub plate side outer diameter thereof and each of the blades is of a two dimensional profile.

13. An impeller as claimed in claim 12, wherein, between said hub plate side outer diameter of the blades and said shroud side outer diameter of the blades, when viewed in the direction of a rotational axis of the impeller, each of said blades comprises a curved line approximating a fluid flow line.

14. An impeller as claimed in claim 12, wherein, between said hub plate side outer diameter of the blades and said shroud side outer diameter of the blades, when viewed in a direction of a rotational axis of the impeller, each of said blades comprises one arc approximating a fluid flow line.

* * * * *